US010273691B2

(12) United States Patent
Wu et al.

(10) Patent No.: US 10,273,691 B2
(45) Date of Patent: Apr. 30, 2019

(54) METHOD OF CONSTRUCTING A REINFORCED COMPOUND CONCRETE BEAM CONTAINING DEMOLISHED CONCRETE LUMPS

(71) Applicant: SOUTH CHINA UNIVERSITY OF TECHNOLOGY, Guangdong (CN)

(72) Inventors: Bo Wu, Guangdong (CN); Simin Jian, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 16/056,384

(22) Filed: Aug. 6, 2018

(65) Prior Publication Data

US 2018/0340334 A1 Nov. 29, 2018

Related U.S. Application Data

(62) Division of application No. 15/522,776, filed as application No. PCT/CN2014/092852 on Dec. 3, 2014, now Pat. No. 10,072,417.

(30) Foreign Application Priority Data

Oct. 31, 2014 (CN) ..... 2014 1 0609233

(51) Int. Cl.
*E04C 3/293* (2006.01)
*E04G 21/00* (2006.01)
*E04C 3/06* (2006.01)

(52) U.S. Cl.
CPC ..... *E04C 3/293* (2013.01); *E04C 3/06* (2013.01); *E04G 21/00* (2013.01)

(58) Field of Classification Search
CPC .. E04C 3/293; E04C 3/294; E04C 2003/0413; E04C 2003/0434; E04C 2003/0452; E04B 5/29; E04B 5/40
See application file for complete search history.

(56) References Cited

U.S. PATENT DOCUMENTS 3,263,387 A * 8/1966 Simpson ..... E04C 3/083 52/634
3,300,932 A * 1/1967 Ratliff, Jr. ..... E04B 5/29 52/339

(Continued)

*Primary Examiner* — Brian E Glessner
*Assistant Examiner* — Daniel J Kenny
(74) *Attorney, Agent, or Firm* — JCIPRNET

(57) ABSTRACT

A method of construction process of a reinforced compound concrete beam containing demolished concrete lumps comprising following steps. Form an I-shaped steel member with a discontinuous top flange by welding a bottom flange plate, a web and two steel plates. Set up a bottom die of the reinforced compound concrete beam. After hoisting the I-shaped steel member with the discontinuous top flange in position, bind longitudinal bars, waist bars and stirrups, and finally set up a side die. (2) Wet the demolished concrete lumps, pour the fresh concrete with a thickness of 20-30 mm inside a cavity formed by the bottom die and the side die, and then put a layer of the wet demolished concrete lumps in a gap between the two steel plates. The two steel plates are two rectangle steel plates or two trapezoid steel plates. Stir artificially so that the demolished concrete lumps are uniformly distributed inside the cavity formed by the bottom die and the side die. Pour a layer of fresh concrete into the cavity and vibrate the demolished concrete lumps and the fresh concrete in the cavity, so that the demolished concrete lumps are uniformly distributed in the fresh concrete. Repeatedly and alternately pour the fresh concrete and the demolished concrete lumps until the cavity is filled.

1 Claim, 3 Drawing Sheets

(56) References Cited

U.S. PATENT DOCUMENTS

| | | | | | |
|---|---|---|---|---|---|
| 3,341,639 | A * | 9/1967 | Naillon | E04B 5/29 | 249/23 |
| 4,115,971 | A * | 9/1978 | Varga | E04B 5/29 | 52/250 |
| 4,196,558 | A * | 4/1980 | Jungbluth | E04C 3/293 | 52/649.2 |
| 6,807,789 | B1 * | 10/2004 | Kim | E01D 19/125 | 52/847 |
| 2011/0225927 | A1 * | 9/2011 | Kim | E04C 3/293 | 52/835 |

* cited by examiner

METHOD OF CONSTRUCTING A REINFORCED COMPOUND CONCRETE BEAM CONTAINING DEMOLISHED CONCRETE LUMPS

CROSS-REFERENCE TO RELATED APPLICATION

This is a divisional application of and claims the priority benefit of U.S. application Ser. No. 15/522,776, filed on Apr. 28, 2017, now allowed. The prior U.S. application Ser. No. 15/522,776 is a 371 application of an International PCT application serial no. PCT/CN2014/092852, filed on Dec. 3, 2014, which claims the priority benefits of China Application No. 201410609233.1, filed on Oct. 31, 2014. The entirety of each of the above-mentioned patent applications is hereby incorporated by reference herein and made a part of this specification.

TECHNICAL FIELD

The present invention relates to the technical field of cyclic utilization of waste concrete, and in particular to an I-shaped steel with discontinuous top flange reinforced compound concrete beam containing demolished concrete lumps and construction process of such beam.

BACKGROUND

I-shaped steel reinforced concrete beam refers to a beam-like member formed by arranging longitudinal bars, waist bars and stirrups around a rolled or welded I-shaped steel then pouring concrete. Since the I-shaped steel reinforced concrete beam has advantages such as high rigidity and high bearing capacity, it has been widely used in real projects. It can be seen from the structural mechanics principle and a large number of structural design examples that, the I-shaped steel reinforced concrete beam in the actual structure only bears positive bending moment near its min-span under the combined effect of vertical load and horizontal load. That is, near the min-span, bottom flange plate of the I-shaped steel is in tension while the top flange plate is in compression. Since the economical efficiency of the compression of the concrete is better than that of the compression of the steel, and the concrete surrounding the top flange plate near the min-span can take on the role of bearing compression. Thus in the case of bearing capacity of the beam remains about the same, the I-shaped steel reinforced concrete beam may be further optimized by reducing min-span parts of the top flange plate of the conventional I-shaped steel, and thereby the purpose of saving steel is realized, but such technology is rarely seen by now.

Since natural sand and gravel mining destroys the environment and the reserves are dwindling, waste concrete, as a valuable "special resource", its recycle use has attracted more and more attention at home and abroad. Compared with recycled coarse aggregate and recycled fine aggregate, adopting demolished concrete lumps with larger scale can greatly simplify recycling process of the waste concrete. However, for the conventional I-shaped steel reinforced concrete beam, due to the obstruction of the continuous top flange plate having penetrating length, putting of the demolished concrete lumps from top to bottom in the pouring process of the beam is very difficult, which is an urgent problem to be solved. In the present invention, a gap of a top flange plate of the I-shaped steel having discontinuous top flange can be just used for putting in the demolished concrete lumps, which can yet be regarded as an effective method for solving this problem.

To sum up, problems exist in the prior arts, such as economical efficiency of the conventional I-shaped steel reinforced concrete beam that needs to be improved, and failure of cyclic utilization of demolished concrete lumps in the conventional I-shaped steel reinforced concrete beam due to difficulty in putting.

SUMMARY OF THE INVENTION

The object of the present invention is to overcome the deficiencies of the prior arts. On one hand, no min-span part of a top flange plate of conventional I-shaped steel is required, and in the case of bearing capacity of a beam remains about the same, the purpose of saving steel is realized. On the other hand, a gap of a discontinuous top flange plate can be just used for putting in demolished concrete lumps, and thereby problem of failure of cyclic utilization of demolished concrete lumps in a conventional I-shaped steel reinforced concrete beam due to difficulty in putting.

Another object the present invention is to provide a construction process of an I-shaped steel with discontinuous top flange reinforced compound concrete beam containing demolished concrete lumps.

The technical solution adopted in the present invention to achieve the above-mentioned object is as follows:

An I-shaped steel with discontinuous top flange reinforced compound concrete beam containing demolished concrete lumps, comprising an I-shaped steel, and longitudinal bars, stirrups and waist bars located outside the I-shaped steel, characterized in that: it further comprises fresh concrete and demolished concrete lumps, which are poured alternately. The I-shaped steel is the I-shaped steel having discontinuous top flange, which consists of a bottom flange plate, a web and a discontinuous top flange plate. The top flange plate and the bottom flange plate are parallel and both perpendicular to the web. The web is located between the top flange plate and the bottom flange plate and welded with the top flange plate and the bottom flange plate respectively.

Further optimized, the discontinuous top flange plate consists of two steel plates located at both sides of the I-shaped steel. The steel plates are rectangle steel plates or trapezoid steel plates. The two steel plates have a same length that is one third of a length of the I-shaped steel. The trapezoid steel plate has a long side located at an end portion of the I-shaped steel. The trapezoid steel plate has a width of a short side no less than a quarter of a width of the long side.

Further optimized, the demolished concrete lumps are waste concrete lumps after demolishing old buildings, structures, roads, bridges or dams and removing protective layers and all or part of steel reinforcements.

Further optimized, the fresh concrete is a natural aggregate concrete or a recycled aggregate concrete, and has a compressive strength no less than 30 MPa.

Further optimized, the demolished concrete lump has a characteristic size no less than 100 mm, and a mass ratio of the demolished concrete lump and the fresh concrete is 1:4-1:1.

A construction process of the above-described I-shaped steel with discontinuous top flange reinforced compound concrete beam containing demolished concrete lumps, which comprises following steps:

(1) forming the I-shaped steel having discontinuous top flange by welding a bottom flange plate, a web and two steel plates in advance, setting up a bottom die of the compound concrete beam first, after hoisting the I-shaped steel with discontinuous top flange in position, binding longitudinal bars, waist bars and stirrups, and finally setting up a side die;

(2) fully wetting demolished concrete lumps in advance, pouring fresh concrete with a thickness of 20-30 mm inside a cavity formed by the bottom die and the side die first, then putting a layer of the wet demolished concrete lumps in a gap between the two rectangle steel plates or trapezoid steel plates, and stirring artificially so that the demolished concrete lumps are uniformly distributed inside the cavity formed by the bottom die and the side die, then pouring a layer of fresh concrete and fully vibrating, so that the demolished concrete lumps and the fresh concrete are uniformly mixed into one; repeatedly and alternately pouring the fresh concrete and the demolished concrete lumps until pouring is finished.

Compared with the prior arts, the present invention has following advantages:

(1) No span part of a top flange plate of conventional I-shaped steel is required, and in the case of bearing capacity of a beam remains about the same, the purpose of saving steel is realized.

(2) Utilizing a gap of the discontinuous top flange plate for putting in the demolished concrete lumps, thereby problem of failure of cyclic utilization of demolished concrete lumps in a conventional I-shaped steel reinforced concrete beam due to difficulty in putting is solved.

(3) Using the demolished concrete lumps for pouring, greatly simplifies treating processes such as crushing, screening and purifying during cyclic utilization of the waste concrete, which saves a large amount of manpower, time and energy, and may realize effective cyclic utilization of the waste concrete.

DETAILED DESCRIPTION OF THE PREFERRED EMBODIMENT

The present invention is further described in detail below in combination with embodiments and accompanying drawings, but implementations of the present invention are not limited thereto. It should be pointed out that, if there is a process that is not specifically described in detail below, those skilled in the art can realize it with reference to the prior arts.

Embodiment 1

Figure 1A:
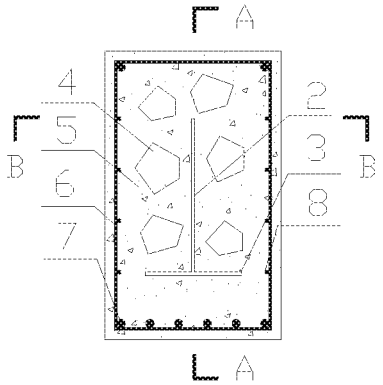
FIG. 1*a*, FIG. 1*b* and FIG. 1*c* are schematic views of transverse section, A-A section and B-B section of the beam according to Embodiment 1 of the I-shaped steel with discontinuous top flange reinforced compound concrete beam containing demolished concrete lumps of the present invention.
Figure 1B:
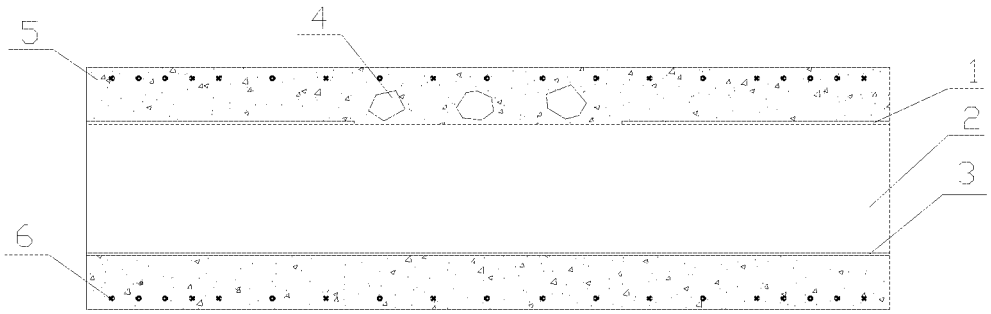
Figure 1C:
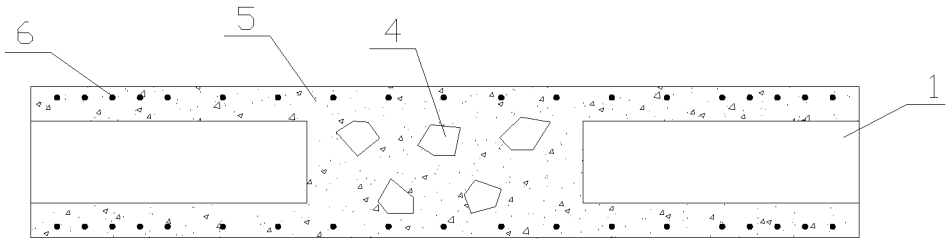

See FIG. 1*a*, FIG. 1*b* and FIG. 1*c*, the I-shaped steel with discontinuous top flange reinforced compound concrete beam containing demolished concrete lumps according to the present invention comprising a discontinuous top flange plate 1, a web 2, a bottom flange plate 3, demolished concrete lumps 4, fresh concrete 5, stirrups 6, longitudinal bars 7, and waist bars 8. The recycled compound concrete beam has a rectangular section, with a beam depth of 850 mm, a beam width of 550 mm, and a beam length of 8100 mm. The discontinuous top flange plate is two 2700 mm×300 mm×12 mm rectangle steel plates. The web and the bottom flange plate are the same as the web and bottom flange plate of a conventional I-shaped steel having a section size of 500 mm×300 mm×10 mm×12 mm, respectively, both of which are Q235 steel material, and have a measured yield strength of 255.8 MPa and an ultimate strength of 330.7 MPa. The fresh concrete has a cube compressive strength of 42.2 MPa, while the demolished concrete lump has a cube compressive strength of 37.6 MPa, and after combination, the cube compressive strength is 40.67 MPa. Horizontal stirrup adopts HRB335-grade steel reinforcement with a diameter of 8 mm, with an interval at an encrypted area being 150 mm, and an interval at a non-encrypted area being 200 mm. The longitudinal bar adopts HRB335-grade steel reinforcement with a diameter of 25 mm, with 2 longitudinal bars being arranged at an upper part, and 6 longitudinal bars being arranged at a lower part. The waist bar adopts HRB335-grade steel reinforcement with a diameter of 8 mm, being arranged at both sides of the I-shaped steel, with each side being 3 waist bars. The demolished concrete lumps are waste concrete lumps after demolishing an old building and removing protective layers and all steel reinforcements. The fresh concrete is a natural aggregate concrete. The demolished concrete lump has a characteristic size of 100-200 mm, and a mass ratio of the demolished concrete lump and the fresh concrete is 1:2.

A construction process of the above-described I-shaped steel with discontinuous top flange reinforced compound concrete beam containing demolished concrete lumps, which comprises following steps:

(1) forming the I-shaped steel having discontinuous top flange by welding a bottom flange plate, a web and two rectangle steel plates in advance, setting up a bottom die of the compound concrete beam first, after hoisting the I-shaped steel having discontinuous top flange in position, binding longitudinal bars, waist bars and stirrups, and finally setting up a side die;

(2) fully wetting demolished concrete lumps in advance, pouring fresh concrete with a thickness of 20 mm inside a cavity formed by the bottom die and the side die first, then putting a layer of the wet demolished concrete lumps in a gap between the two rectangle steel plates, and stirring artificially so that the demolished concrete lumps are uniformly distributed inside the cavity formed by the bottom die and the side die, then pouring a layer of fresh concrete and fully vibrating, so that the demolished concrete lumps and the fresh concrete are uniformly mixed into one; repeatedly and alternately pouring the fresh concrete and the demolished concrete lumps until pouring is finished.

For the purpose of comparison, a conventional I-shaped steel having a section size of 500 mm×300 mm×10 mm×12 mm and same material, same longitudinal bars, stirrups and waist bars, and natural aggregate concrete having a cube compressive strength of 40.67 MPa are taken, to produce a composite beam with internal conventional I-shaped steel. It is eventually found that the I-shaped steel with discontinuous top flange reinforced compound concrete beam containing demolished concrete lumps in the present embodiment has a flexural bearing capacity of normal section of 1846 kN·m, while the composite beam with internal conventional I-shaped steel has a flexural bearing capacity of normal section of 1932 kN·m. By calculating, it can be seen that the flexural bearing capacity of normal section of the two beams is only 4.4% difference, but the former not only saves 10.03% of steel, but also puts 1.26 cubic meters of demolished concrete lumps into recycling.

Embodiment 2

Figure 2A:
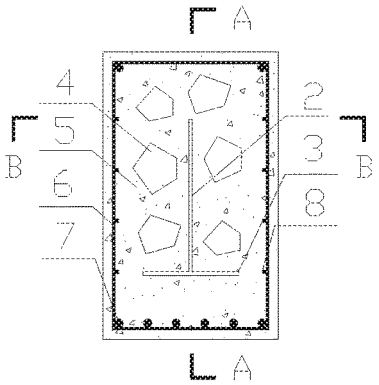
FIG. 2*a*, FIG. 2*b* and FIG. 2*c* are schematic views of transverse section, A-A section and B-B section of the beam according to Embodiment 2 of the I-shaped steel with discontinuous top flange reinforced compound concrete beam containing demolished concrete lumps of the present invention.
Figure 2B:
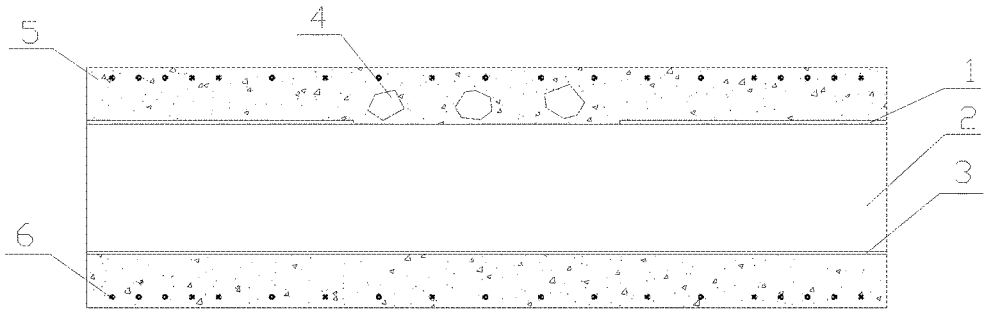
Figure 2C:
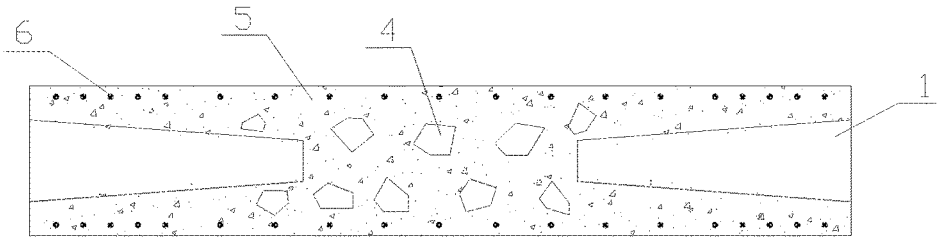

See FIG. 2*a*, FIG. 2*b* and FIG. 2*c*, the I-shaped steel with discontinuous top flange reinforced compound concrete beam containing demolished concrete lumps according to the present invention comprising a discontinuous top flange plate 1, a web 2, a bottom flange plate 3, demolished concrete lumps 4, fresh concrete 5, stirrups 6, longitudinal bars 7 and waist bars 8. The recycled compound concrete beam has a rectangular section, with a beam depth of 850 mm, a beam width of 550 mm, and a beam length of 8100 mm. The discontinuous top flange plate is two (150 mm+300 mm)×2100 mm×12 mm trapezoid steel plates. The web and the bottom flange plate are the same as the web and bottom flange plate of a conventional I-shaped steel having a section size of 500 mm×300 mm×10 mm×12 mm, respectively, which are Q235 steel material, and have a measured yield strength of 255.8 MPa, and an ultimate strength of 330.7 MPa. The fresh concrete has a cube compressive strength of 42.2 MPa, while the demolished concrete lump has a cube compressive strength 37.6 MPa, and after combination, the cube compressive strength is 40.67 MPa. Horizontal stirrup adopts HRB335-grade steel reinforcement with a diameter of 8 mm, with an interval at an encrypted area being 150 mm, and an interval at a non-encrypted area being 200 mm. The longitudinal bar adopts HRB335-grade steel reinforcement with a diameter of 25 mm, with 2 longitudinal bars being arranged at an upper part, and 6 longitudinal bars being arranged at a lower part. The waist bar adopts HRB335-grade steel reinforcement with a diameter of 8 mm, being arranged at both sides of the I-shaped steel, with each side being 3 waist bars. The demolished concrete lumps are waste concrete lumps after demolishing an old building and removing protective layers and all steel reinforcements. The fresh concrete is a natural aggregate concrete. The demolished concrete lump has a characteristic size of 100-200 mm, and a mass ratio of the demolished concrete lump and the fresh concrete is 1:2.

A construction process of the above-described I-shaped steel with discontinuous top flange reinforced compound concrete beam containing demolished concrete lumps, which comprises following steps:

(1) Forming the I-shaped steel having discontinuous top flange by welding a bottom flange plate, a web and two trapezoid steel plates in advance, setting up a bottom die of the compound concrete beam first, after hoisting the I-shaped steel having discontinuous top flange in position, then binding longitudinal bars, stirrups and waist bars, and finally setting up a side die;

(2) fully wetting demolished concrete lumps in advance, pouring fresh concrete with a thickness of 30 mm inside a cavity formed by the bottom die and the side die first, then putting a layer of the wet demolished concrete lumps in a gap between the two trapezoid steel plates, and stirring artificially so that the demolished concrete lumps are uniformly distributed inside the cavity formed by the bottom die and the side die, then pouring a layer of fresh concrete and fully vibrating, so that the demolished concrete lumps and the fresh concrete are uniformly mixed into one; repeating the above-described process until pouring is finished.

For the purpose of comparison, a conventional I-shaped steel having a section size of 500 mm×300 mm×10 mm×12 mm and same material, same longitudinal bars, stirrups and waist bars, and natural aggregate concrete having a cube compressive strength of 40.67 MPa are taken, to produce a composite beam with internal conventional I-shaped steel. It is eventually found that the I-shaped steel with discontinuous top flange reinforced compound concrete beam containing demolished concrete lumps in the present embodiment has a flexural bearing capacity of normal section of 1846 kN·m, while the composite beam with internal conventional I-shaped steel has a flexural bearing capacity of normal section of 1932 kN·m. By calculating, it can be seen that the flexural bearing capacity of normal section of the two beams is only 4.4% difference, but the former not only saves 15.05% of steel, but also puts 1.26 cubic meters of demolished concrete lumps into recycling.

Embodiment 3

Figure 3A:
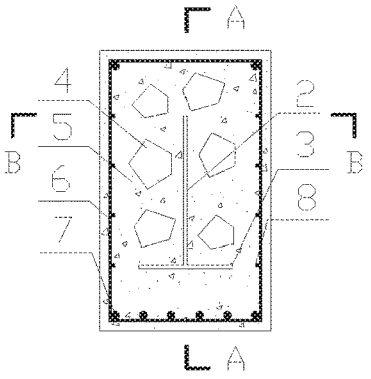
FIG. 3*a*, FIG. 3*b* and FIG. 3*c* are schematic views of transverse section, A-A section and B-B section of the beam according to Embodiment 3 of the I-shaped steel with discontinuous top flange reinforced compound concrete beam containing demolished concrete lumps of the present invention.
Figure 3B:
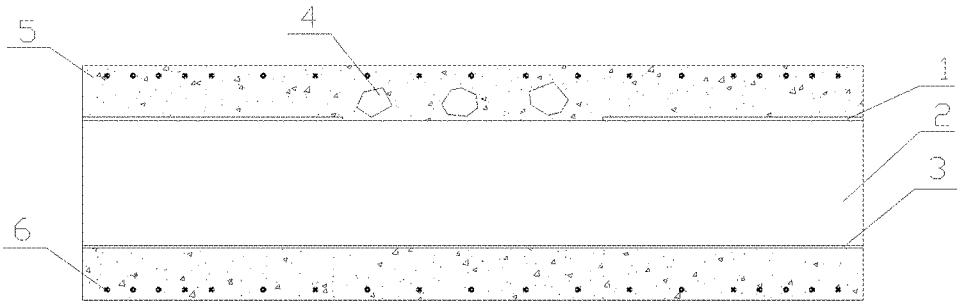
Figure 3C:
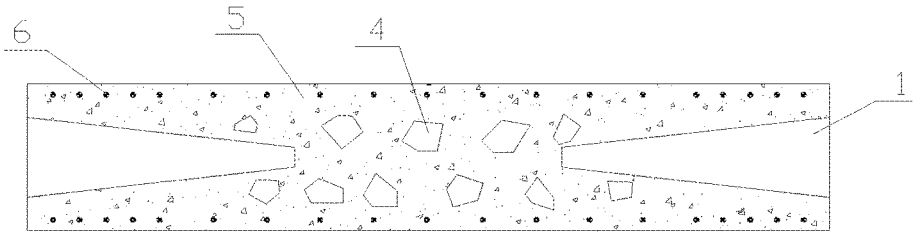

See FIG. 3*a*, FIG. 3*b* and FIG. 3*c*, the I-shaped steel with discontinuous top flange reinforced compound concrete beam containing demolished concrete lumps according to the present invention comprising a discontinuous top flange plate 1, a web 2, a bottom flange plate 3, demolished concrete lumps 4, fresh concrete 5, stirrups 6, longitudinal bars 7 and waist bars 8. The recycled compound concrete beam has a rectangular section, with a beam depth of 850 mm, a beam width of 550 mm, and a beam length of 8100 mm. The discontinuous top flange plate is two (75 mm+300 mm)×2100 mm×12 mm trapezoid steel plates. The web and the bottom flange plate are the same as the web and bottom flange plate of a conventional I-shaped steel having a section size of 500 mm×300 mm×10 mm×12 mm, respectively, which are Q235 steel material, and have a measured yield strength of 255.8 MPa, and an ultimate strength of 330.7 MPa. The fresh concrete has a cube compressive strength of 42.2 MPa, while the demolished concrete lump has a cube compressive strength of 37.6 MPa, and after combination, the cube compressive strength is 41.05 MPa. Horizontal stirrup adopts HRB335-grade steel reinforcement with a diameter of 8 mm, with an interval at an encrypted area being 150 mm, and an interval at a non-encrypted area being 200 mm. The longitudinal bar adopts HRB335-grade steel reinforcement with a diameter of 25 mm, with 2 longitudinal bars being arranged at an upper part, and 6 longitudinal bars being arranged at a lower part. The waist bar adopts HRB335-grade steel reinforcement with a diameter of 8 mm, being arranged at both sides of the I-shaped steel, with each side being 3 waist bars. The demolished concrete lumps are waste concrete lumps after demolishing an old building and removing protective layers and all steel reinforcements. The fresh concrete is a natural aggregate concrete. The demolished concrete lump has a characteristic size of 100-200 mm, and a mass ratio of the demolished concrete lump and the fresh concrete is 1:3.

A construction process of the above-described I-shaped steel with discontinuous top flange reinforced compound concrete beam containing demolished concrete lumps, which comprises following steps:

(1) Forming the I-shaped steel having discontinuous top flange by welding a bottom flange plate, a web and two trapezoid steel plates in advance, setting up a bottom die of the compound concrete beam first, after hoisting the I-shaped steel having discontinuous top flange in position, then binding longitudinal bars, stirrups and waist bars, and finally setting up a side die;

(2) fully wetting demolished concrete lumps in advance, pouring fresh concrete with a thickness of 20 mm inside a cavity formed by the bottom die and the side die first, then putting a layer of the wet demolished concrete lumps in a gap between the two trapezoid steel plates, and stirring artificially so that the demolished concrete lumps are uniformly distributed inside the cavity formed by the bottom die and the side die, then pouring a layer of fresh concrete and fully vibrating, so that the demolished concrete lumps and the fresh concrete are uniformly mixed into one; repeating the above-described process until pouring is finished.

For the purpose of comparison, a conventional I-shaped steel having a section size of 500 mm×300 mm×10 mm×12 mm and same material, same longitudinal bars, stirrups and waist bars, and natural aggregate concrete having a cube compressive strength of 41.05 MPa are taken, to produce a composite beam with internal conventional I-shaped steel. It is eventually found that the I-shaped steel with discontinuous top flange reinforced compound concrete beam containing demolished concrete lumps in the present embodiment has a flexural bearing capacity of normal section of 1852 kN·m, while the composite beam with internal conventional I-shaped steel has a flexural bearing capacity of normal section of 1936 kN·m. By calculating, it can be seen that the flexural bearing capacity of normal section of the two beams is only 4.34% difference, but the former not only saves 17.56% of steel, but also puts 0.95 cubic meters of demolished concrete lumps into recycling.

The above are preferred implementations of the present invention, but the implementations of the present invention are not limited by the above content. Any other changes, modifications, substitutions, combinations and simplifications that are not deviated from the spirit and principles of the present invention should be equivalent replacements, which are included within the scope of protection of the present invention.

What is claimed:

1. A method of constructing a reinforced compound concrete beam containing demolished concrete lumps, the method comprising:

(1) forming an I-shaped steel member with a discontinuous top flange by welding one bottom flange plate and two steel plates to a web, preparing a bottom die portion of a die for casting the reinforced compound concrete beam, then hoisting the I-shaped steel member with the discontinuous top flange in position on the bottom die portion, and then binding together longitudinal bars, waist bars and stirrups, and finally setting up a side die portion of the die for casting the reinforced compound concrete beam;

(2) wetting the demolished concrete lumps, pouring the fresh concrete to a thickness of 20-30 mm inside a cavity formed by the bottom die and the side die, and then putting a layer of the wet demolished concrete lumps in a gap between the two steel plates, the two steel plates being two rectangle steel plates or two trapezoid steel plates, and stirring the wet demolished concrete lumps so that the wet demolished concrete lumps are uniformly distributed inside the cavity formed by the bottom die and the side die, then pouring a layer of fresh concrete into the cavity formed by the bottom die and the side die and vibrating the wet demolished concrete lumps and the fresh concrete in the cavity formed by the bottom die and the side die, so that the wet demolished concrete lumps are uniformly distributed in the fresh concrete;

repeatedly and alternately pouring the fresh concrete and the wet demolished concrete lumps until the cavity formed by the bottom die and the side die is filled.

* * * * *